US008654616B1

(12) United States Patent
Pope et al.

(10) Patent No.: US 8,654,616 B1
(45) Date of Patent: Feb. 18, 2014

(54) VISUAL ALERT DEVICE

(75) Inventors: James W. Pope, Wadsworth, OH (US); Richard T. Kessler, Richfield, OH (US)

(73) Assignee: Visilert, L.L.C., Wadsworth, OH (US)

( * ) Notice: Subject to any disclaimer, the term of this patent is extended or adjusted under 35 U.S.C. 154(b) by 204 days.

(21) Appl. No.: 13/298,447

(22) Filed: Nov. 17, 2011

Related U.S. Application Data

(63) Continuation of application No. 12/387,587, filed on May 6, 2009, now Pat. No. 8,077,552.

(51) Int. Cl.
*G04C 17/00* (2006.01)

(52) U.S. Cl.
USPC ..... 368/241; 368/79; 368/109

(58) Field of Classification Search
USPC ..... 368/109, 82–84, 239–242
See application file for complete search history.

(56) References Cited

U.S. PATENT DOCUMENTS

| | | | | |
|---|---|---|---|---|
| 4,367,527 | A * | 1/1983 | Desjacques | 368/107 |
| 4,456,383 | A * | 6/1984 | Speckhart et al. | 368/9 |
| D283,403 | S * | 4/1986 | Chan | D10/40 |
| D313,759 | S * | 1/1991 | Nomizu | D10/31 |
| 4,995,018 | A * | 2/1991 | Edwards | 368/107 |
| 6,326,883 | B1 * | 12/2001 | Whitehead et al. | 340/309.8 |
| 6,817,192 | B2 * | 11/2004 | Ector et al. | 62/125 |

* cited by examiner

*Primary Examiner* — Sean Kayes
(74) *Attorney, Agent, or Firm* — Renner, Kenner, Greive, Bobak, Taylor & Weber

(57) ABSTRACT

A visual alert device includes a keypad for a user to enter a primary follow-up time period for which a user desires to be visually reminded of its progressive expiration. Based on the entered primary follow-up time period, the visual alert device computes a preliminary and a final follow-up time value, which are associated with a level of response priority that is visually represented by the illumination of corresponding illuminable color segments. Thus, when a timer of the visual alert device reaches each of the preliminary follow-up time value, the primary follow-up time period, and the final follow-up time value, the corresponding color segments are illuminated to indicate the current response priority level.

19 Claims, 11 Drawing Sheets

VISUAL ALERT DEVICE

CROSS-REFERENCE TO RELATED APPLICATION

This application is a continuation of U.S. patent application Ser. No. 12/387,587 filed May 6, 2009 now U.S. Pat. No. 8,077,552.

TECHNICAL FIELD

The present invention relates to alert devices used to visually identify the progressive expiration of a predetermined time period. Particularly, the present invention is directed to visual alert devices that utilize illuminable identifiers having multiple colors to indicate levels of response priority. More particularly, the present invention is directed to visual alert devices that visibly indicate multiple levels of response priority that are associated with predetermined time periods.

BACKGROUND

Hospital staff, including nurses and other caregivers, are generally required to provide periodic follow-up visits to each patient being treated during their daily "rounds." However, due to the busy hospital environment, caregivers often become involved with other urgent tasks and are distracted from their rounds. As a result, the caregiver may not follow up with the patient in a timely manner, which may lead to a lapse in critical care required by the patient. In addition, electronic monitoring, diagnostic, and communication devices that generate various audible tones or sounds are ubiquitous in the hospital environment. Due to the quantity and nature of such sounds, hospital staff, including caregivers, are likely to become desensitized to these sounds, and as a result, audible prompts to gain the attention of a caregiver are largely disregarded. Thus, it would be desirable to have an alert device to visually remind the caregiver that his or her rounds period has expired or is nearing expiration.

Additionally, other circumstances exist in which the monitoring of the progressive expiration of a predetermined time interval is critical in the achievement of a successful result. For example, in the case of food preparation, chefs, cooks, and other food preparers are required to continuously monitor the cooking of various types of food, each of which may be at various stages of completion. For example, an individual may be baking a cake, cooking pasta, and marinating beef simultaneously and as such, must remember to periodically return to or follow up with each food item in order to ensure that it is not over prepared. While timers provided by the various equipment can be used to notify the individual when a predetermined time period has expired, such indications are generally audible in nature and can be easily drowned out by the ambient noise in a kitchen, resulting in a lapse in the monitoring of the food, which may result in its overcooking. Thus, it would be advantageous to have an alert device that visually reminds an individual of the progressive expiration of a predetermined cooking time to avoid the overcooking of food.

Therefore, there is a need for a visible alert device that provides a visual indicator to remind a caregiver of the need to attend to his or her patient. Additionally, there is a need for a visible alert device that visually represents multiple levels of priority associated with predetermined time periods.

SUMMARY OF THE INVENTION

It is thus an object of one aspect of the present invention to provide a visual alert device to illuminate different color segments of an illuminable identifier based on the progressive expiration of a predetermined primary follow-up time period.

It is an object of another aspect of the present invention to provide a visual alert device that provides a spring-biased clip that includes a hang tab and a magnet, thus allowing the visual alert device to be mounted in a variety of locations.

It is another object of yet another aspect of the present invention to provide a visual alert device that provides an illuminable identifier with two substantially orthogonal illumination surfaces to increase its viewing angle.

These and other objects of the present invention, as well as the advantages thereof over existing prior-art forms, which will become apparent from the description to follow, are accomplished by the improvements hereinafter described and claimed.

In general, a visual alert device includes at least one illuminable identifier having at least three different color segments. A controller, which also includes a timer, is coupled to the illuminable identifier to control the illumination of the color segments. Also coupled to the controller is a numeric keypad to enter a primary follow-up time period in which the controller computes at least a preliminary and final follow-up time value. When a start/stop button, which is coupled to the controller is actuated, the first color segment is illuminated and the timer is started, such that when the timer reaches the preliminary follow-up time value, the second color segment is illuminated; when the timer reaches the primary follow-up time period, the second color segment is pulsed; and when the timer reaches the final follow-up time value, the third color segment is illuminated.

The invention also relates to a method of providing a visual alert including the steps of providing a visual alert device including a keypad and an illuminable identifier having at least three different color segments, entering a primary follow-up time period via the keypad, computing a preliminary and a final follow-up time value based on the primary follow-up time period, initiating a timer, illuminating the first color segment, illuminating the second color segment when the timer reaches the preliminary follow-up time value, pulsing the second color segment when the timer reaches the primary follow-up time period, and illuminating the third color segment state when the timer reaches the final follow-up time value.

According to another aspect of the invention, a visual alert device provides at least one illuminable identifier having a plurality of different color segments. A controller is coupled to the illuminable identifier to control the illumination of the color segments. Coupled to the controller is a numeric keypad to enter a primary follow-up time period, such that when a start/stop button coupled to the controller is actuated, a first color segment is illuminated and the timer is started, and when the timer reaches the primary follow-up time period, a second color segment is illuminated.

PREFERRED EMBODIMENT FOR CARRYING OUT THE INVENTION

Figure 1:
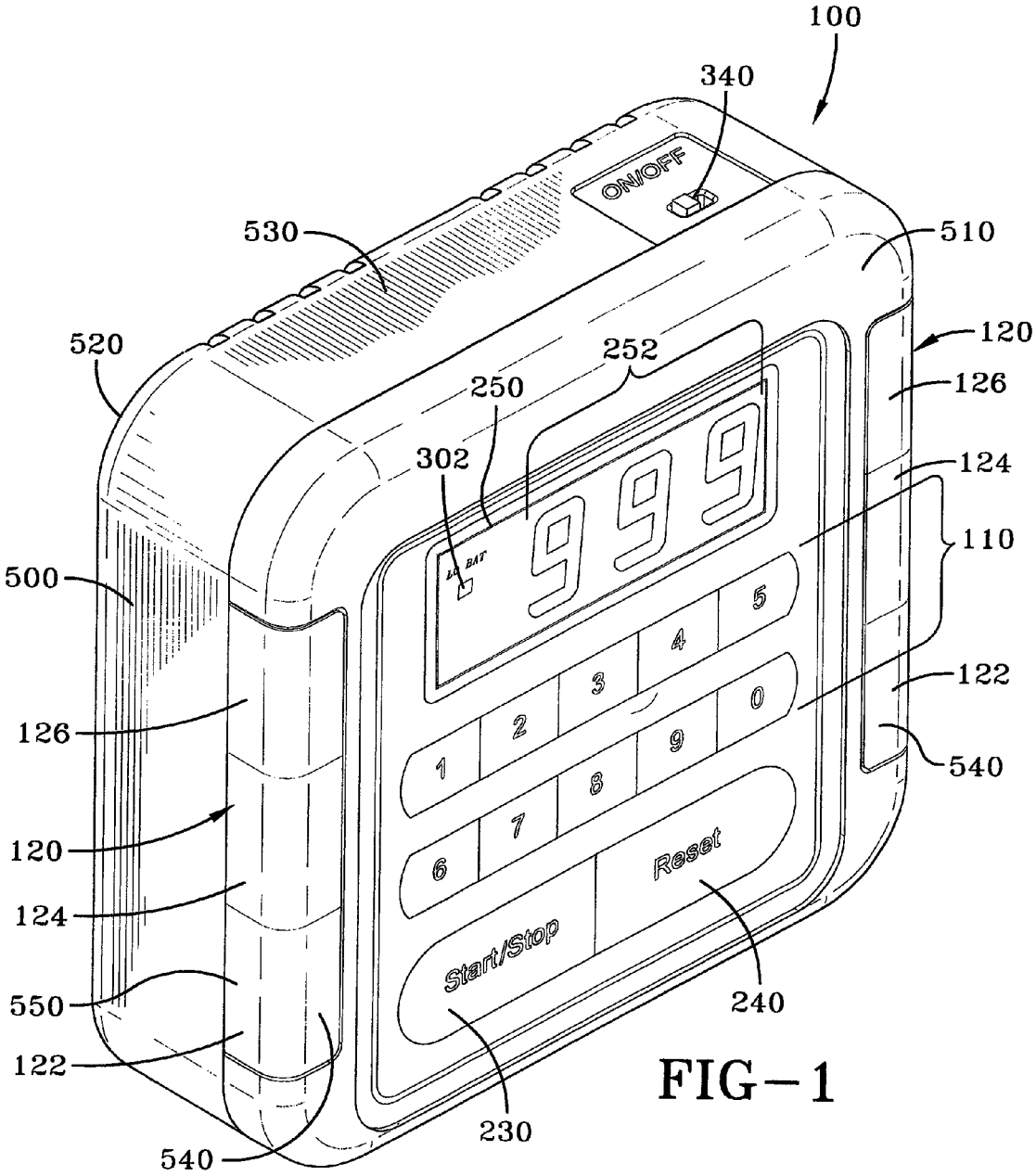
FIG. 1 is a perspective view of a visual alert device made in accordance with the concepts of the present invention.

A visual alert device is generally referred to by the numeral 100, which updates a count based on a predetermined primary follow-up time period set by a user via a numeric keypad 110. While the following discussion relates to the use of the visual alert device 100 by patient caregivers in a hospital, such should not be construed as limiting, as the visual alert device 100 may be utilized in any circumstance where a visual indicator of the progression of an elapsed time period is desired. For example, the visual alert device 100 may be used in the areas of cooking, compliance with prescription dosing intervals, time monitoring during test administration, and the like. Continuing, the primary follow-up time period identifies the amount of time between successive follow-ups that the caregiver is to make with the patient. In order to visually remind the caregiver of the progressive expiration of the entered primary follow-up time period, the visual alert device 100 includes illuminable identifier systems 120, each of which includes a green color segment 122, a yellow color segment 124, and a red color segment 126. The green, yellow, and red color segments 122-126 are illuminated based on the amount of time that remains before the expiration of the primary follow-up time period and the amount of time that has elapsed beyond the expiration of the primary follow-up time period. As such, the green, yellow, and red segments 122-126 represent levels of alert or response priority, which are associated with the remaining amount of time in the primary follow-up time period. For example, when the green color segment 122 is illuminated, a low response priority or alert level exists; when the yellow color segment 124 is illuminated or flashes, a medium or moderate response priority or alert level exists; and when the red color segment 126 is illuminated, a high response priority or alert level exists. As such, the visual alert device 100 allows the caregiver to plan his or her activities accordingly between scheduled patient follow-ups, based on the current priority level, so that follow-ups with the patient are made in a consistent and timely manner.

Figure 2:
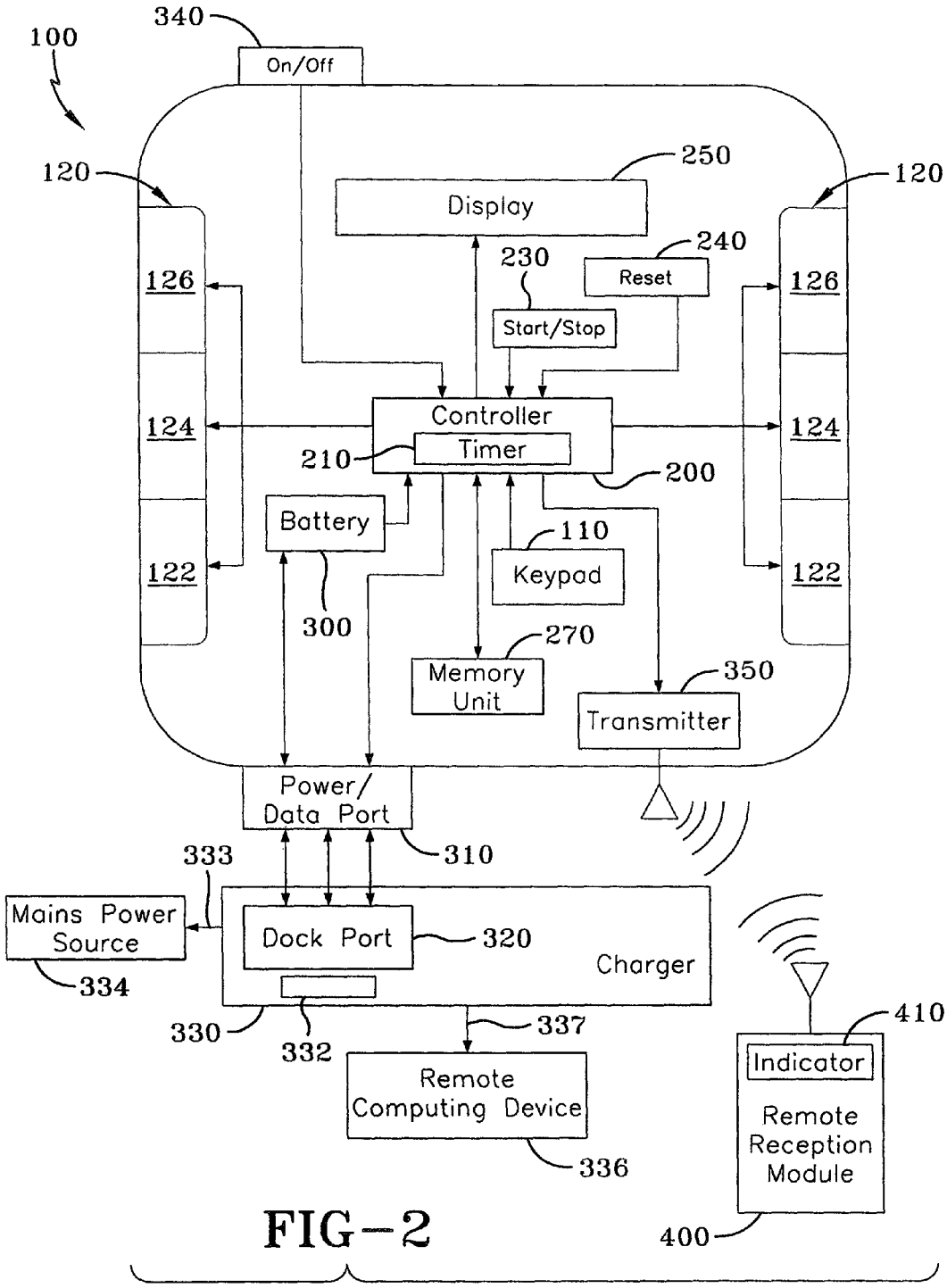
FIG. 2 is a block diagram of the components of the visual alert device.

With reference to FIG. 2, the components of the visual alert device 100 include a controller 200, which provides the necessary hardware, software, or combination of both to carry out the various functions to be discussed. The controller 200 includes a timer 210, which generates a count value that is used to identify the amount of time that has expired since the visual alert device 100 was started. For example, the timer 210 is used to determine when the primary follow-up time period has been reached. It should be appreciated that while the timer 210 is shown as being integral with the components of the controller 200, it may be maintained as a separate component. Coupled to the controller 200 is the numeric keypad 110, which allows the caregiver to enter the primary follow-up time period that defines the desired amount of time between patient follow-ups, or alternatively, in other contexts outside of the hospital setting, the desired amount of time prior to the completion of a particular activity or event. Additionally, the numeric keypad 110 may be configured to allow the user to enter the primary follow-up time period in any increment, such as seconds, minutes, or hours, as desired.

The visual alert device 100 also includes a start/stop button 230 that when depressed starts the timer 210 and when subsequently depressed stops the timer 210, as well as providing other functions, as will hereinafter be discussed. A reset button 240 is also coupled to the controller 200, such that when it is depressed, the timer 210 is reset back to zero, as well as providing other functions to be hereinafter discussed.

A display 250 is also coupled to the controller 200 to allow the caregiver to view the primary follow-up time period as it is entered via the numeric keypad 110. In addition, once the visual alert device 100 is started upon the depression of the start/stop button 230, the display 250 also provides a visual time indication 252, shown in FIG. 1, of the amount of time remaining in the entered primary follow-up time period. Display 250 may be an LCD (liquid crystal display) display, an LED (light emitting diode) display, or any other suitable display type.

In order to provide a visual indication of the progression of the expiration of the primary follow-up time period that has been entered, the visual alert device 100 includes the illuminable indicators 120, which, as previously described, maintain the green, yellow, and red color segments 122-126, which are illuminated in accordance with an operating process or sequence to be discussed in detail below. Specifically, the illuminable indicators 120 may be LEDs (light emitting diodes), as well as electroluminescent, incandescent, or any other suitable light source, such that when they are powered, any one of the green, yellow, and red color segments 122-126 are illuminated. It should be appreciated that colors other than green, yellow, and red may be used for the segments 122-126 and that embodiments in which the visual alert device 100 utilizes more or less than the three color segments 122-126 are also contemplated.

A memory unit 270, which may include volatile memory, non-volatile memory, or a combination of both, is also coupled to the controller 200 to allow the visual alert device 100 to record the number of times that each of the color segments 122-126 has been illuminated or has transitioned from a constant illumination state to a flashing illumination state. For example, the controller 200 may record and store the number of times that the color segments 122-126 have transitioned from green to yellow, from yellow to flashing yellow, and from flashing yellow to red.

The visual alert device 100 may be powered by a rechargeable battery 300; however, it should be appreciated that the visual alert device 100 may be readily configured to be powered by AC (alternating current) power that is supplied by a wall outlet or existing electrical wiring. If battery powered, when the power of the battery 300 becomes depleted, a low-battery indicator 302, as shown in FIG. 1, is presented upon the display 250 to prompt the user to recharge the battery 300.

Figure 3:
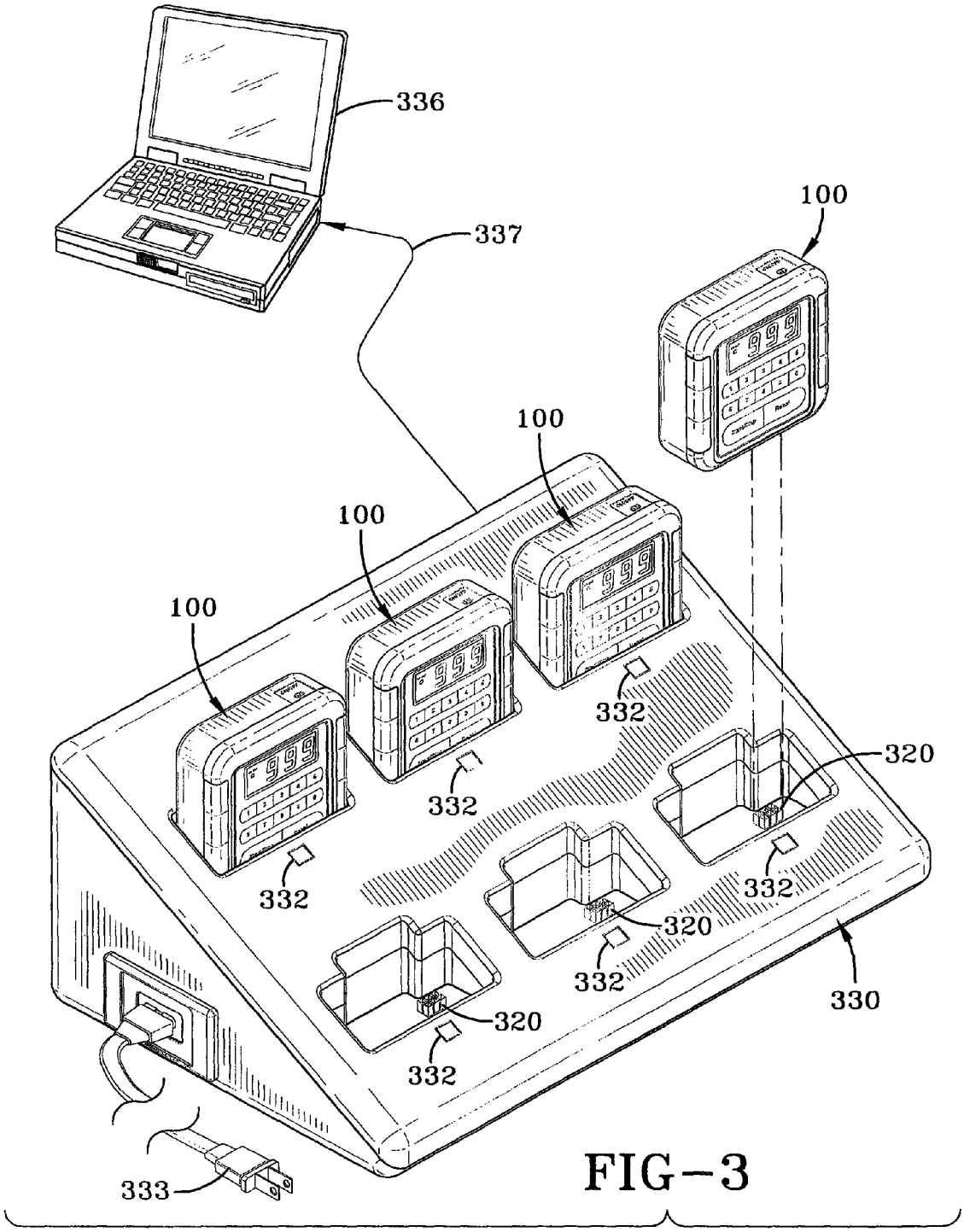
FIG. 3 is a perspective view of a charger used to charge one or more of the visual alert devices.
Figure 4:
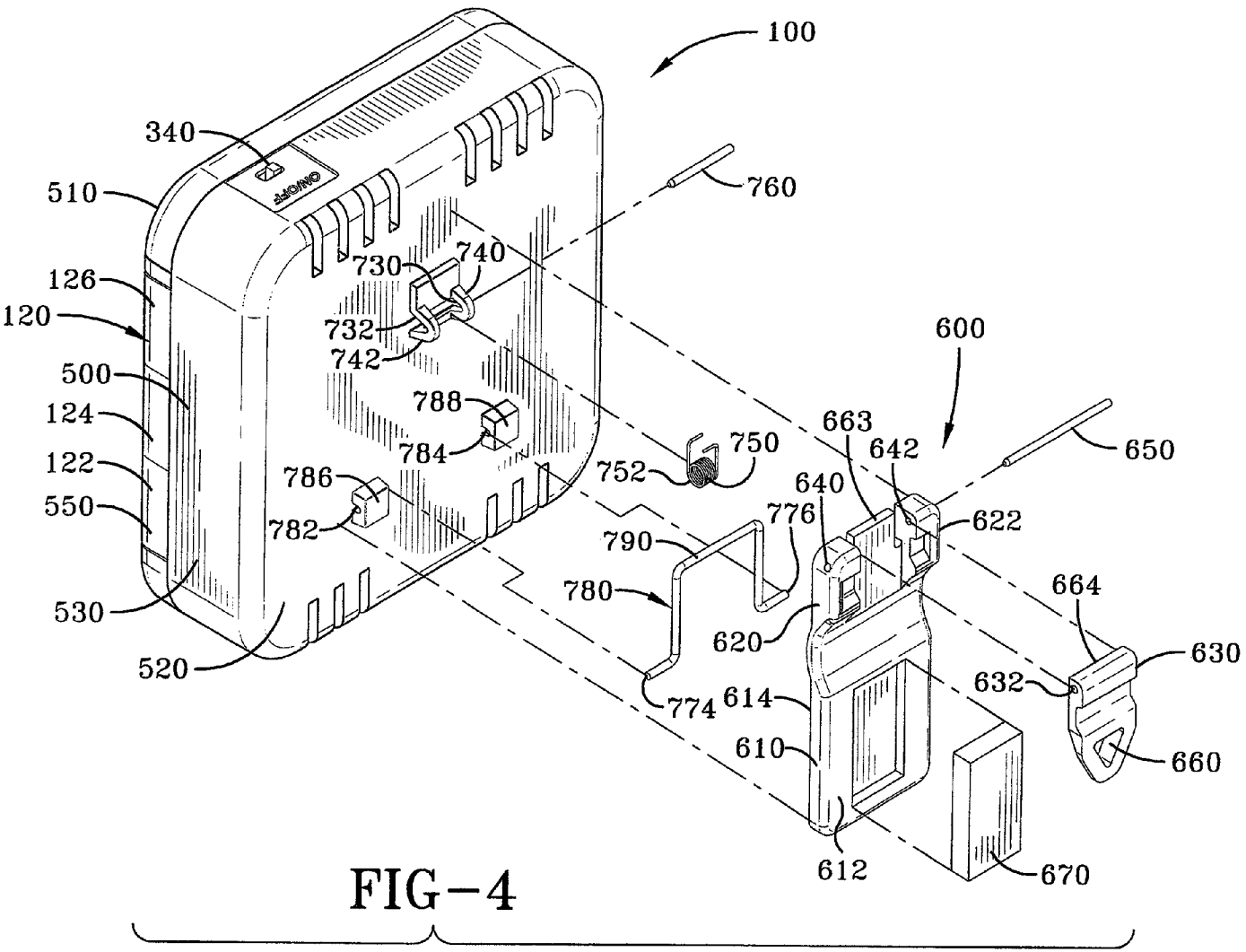
FIG. 4 is an exploded perspective view of the visual alert device showing an attachment assembly of the visual alert device in accordance with the concepts of the present invention.
Figure 5:
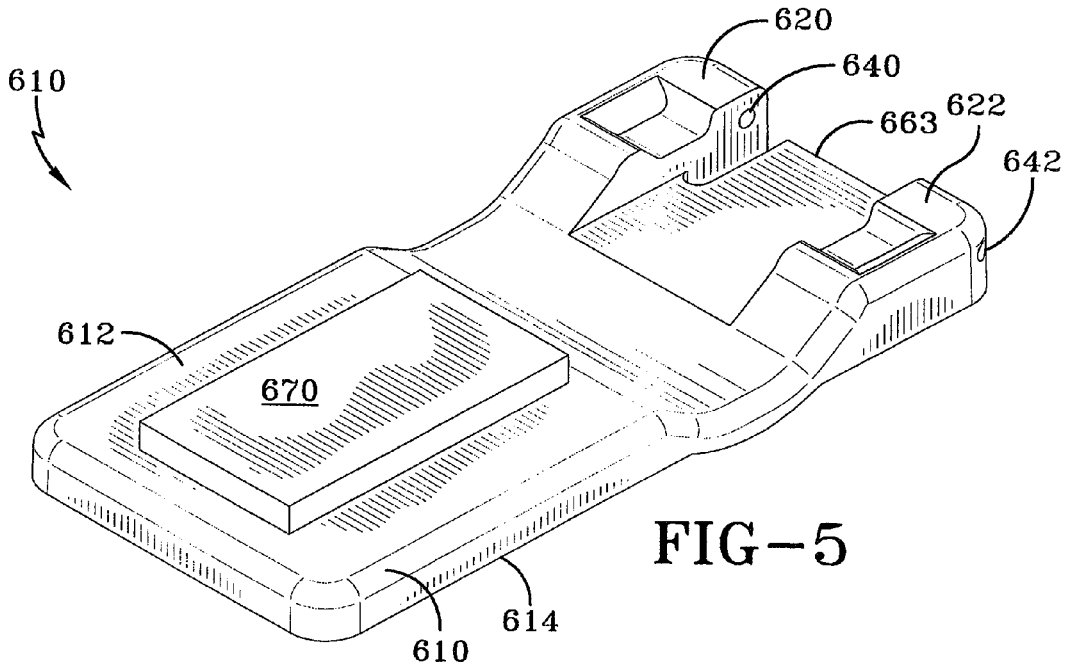
FIG. 5 is a perspective view of the outer surface of a clip provided by the attachment assembly of the visual alert device.

A power/data port 310 is also coupled to the battery 300 and to the controller 200, which allows the battery 300 to be recharged when the power/data port 310 is interfaced with a dock port 320 maintained by a charger 330. In one aspect, as shown in FIG. 3, the charger 330 may be capable of charging one or more visual alert devices 100 and may include a charge status indicator 332, such as an LED (light emitting diode), that changes color based on the charging status of the battery 300 of each associated alert device 100 that is inserted into the dock port 320 of the charger 300. For example, the status indicator 332 may be illuminated green to indicate that the battery 300 is charging; may be illuminated red to indicate that the battery 300 is fully charged; and may be illuminated yellow to indicate that the battery 300 needs replacement. However, it should be appreciated that the status indicator 332 may take on any desired color to indicate such charging states. It should also be appreciated that the charger 300 includes an electrical plug 333 for attachment to an AC power source 334. In addition to charging the battery 300, the power/data port 310 may also be used to transfer data stored at the memory unit 270 of the alert device 100 to a remote computing device 336 coupled to the charger 330 via a data cable 337. However, it should be appreciated that the remote computing device 336 may also be coupled to the power/data port 310 of the visual alert device 100 directly, without the use of the charger 300, to communicate data from the memory unit 270 to the remote computing device 336. For example, either of the charger 300 or the visual alert device 100 may communicate data from the memory unit 270 to the remote computing device 336 via a wired connection or wirelessly using any suitable data transmission protocol, such as WIFI or BLUETOOTH. Finally, the visual alert device 100 includes an on/off switch 340 that allows the caregiver to turn the visual alert device 100 on and off as needed.

In accordance with another aspect of the invention, the visual alert device 100 may include a transmitter 350 that is capable of transmitting a communication signal, such as an RF (radio frequency) signal, to a remote reception module 400, so as to initiate a prompt via an audible and/or visual indicator 410 maintained thereby. As such, the communication signal may contain data indicating which color segment 122-126 is currently illuminated at the visual alert device 100, and as such, the indicator 410 may illuminate green, yellow, or red to match the currently illuminated color segment 122-126 of the alert device 100.

The components of the visual alert device 100 are maintained by a housing 500, as shown in FIGS. 1 and 4-13, which includes a front surface 510 that is separated from a rear surface 520 by an intermediate surface 530. The intermediate surface 530 is substantially orthogonal or substantially at a right angle to that of the front and rear surfaces 510, 520 of the housing 500, such that the housing 500 is substantially block-shaped, although the housing 500 may take on any other desired shape. Housing 500 may be formed from any suitable material, such as plastic or aluminum for example.

The illuminable indicators 120, shown clearly in FIG. 1, include a primary illuminating surface 540 that extends at a substantially right angle to a lateral illuminating surface 550 and is maintained by the housing 500, such that the green, yellow, and red segments 122-126 extend upon the front surface 510 and the intermediate surface 530 of the housing 500. In other words, the illuminable indicators 120 are oriented such that the primary surface 540 is disposed upon the front surface 510 of the housing 500, and the lateral surface 550 is disposed upon the intermediate surface 530 of the housing 500. Thus, when the green, yellow, and red segments 122-126 are illuminated, they are visually identifiable when the caregiver views either of the front surface 510 or either intermediate surface 530 of the visual alert device 100 and, therefore, provide a wide angle of view for the caregiver. The wide viewing angle at which the illuminable identifiers 120 can be seen allows the visual alert device 100 to be mounted, located, or installed in a variety of regions, while still enabling the caregiver to view the alert status presented by the illuminable identifiers 120. While the illuminable identifiers 120 maintain illuminating surfaces 540 and 550 that are at a substantially right angle to one another, it is also contemplated that the illuminating surfaces 540, 550 may be oriented at other angles to further enhance viewing by a caregiver or other individual.

Figure 8:
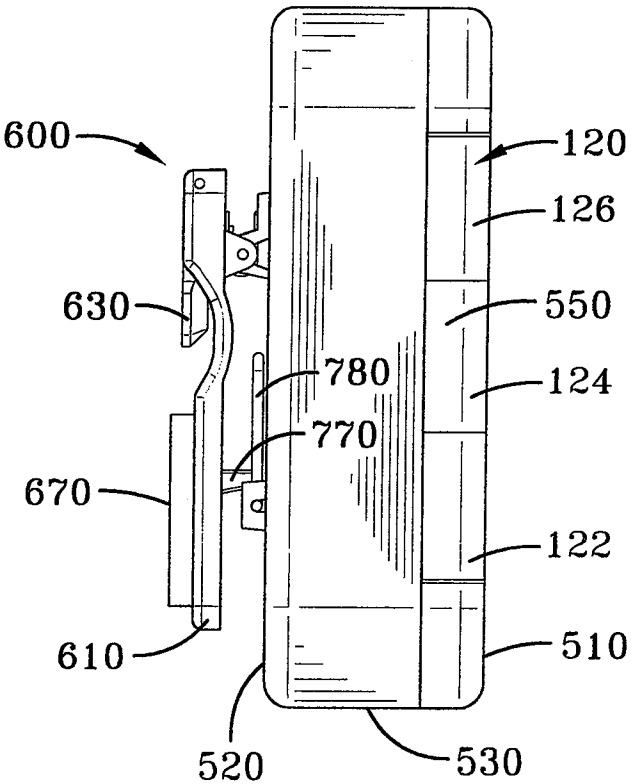
FIG. 8 is a side elevational view thereof.
Figure 7:
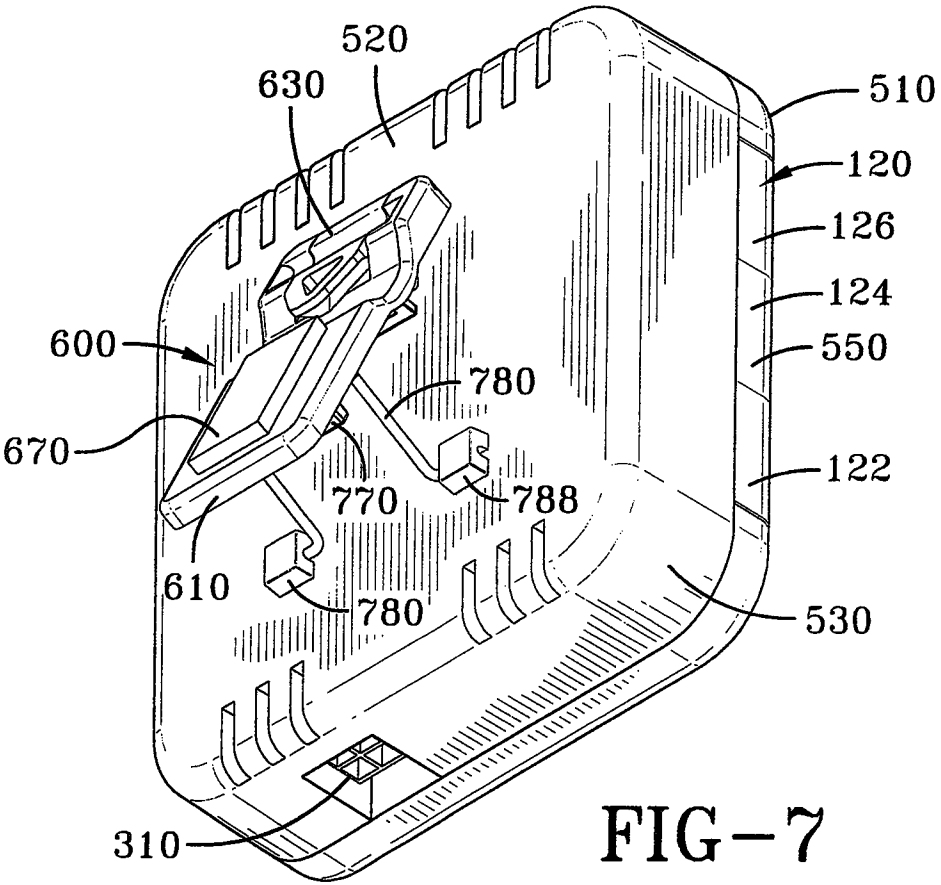
FIG. 7 is a perspective view of the rear and bottom of the visual alert device in accordance with the concepts of the present invention.
Figure 12:
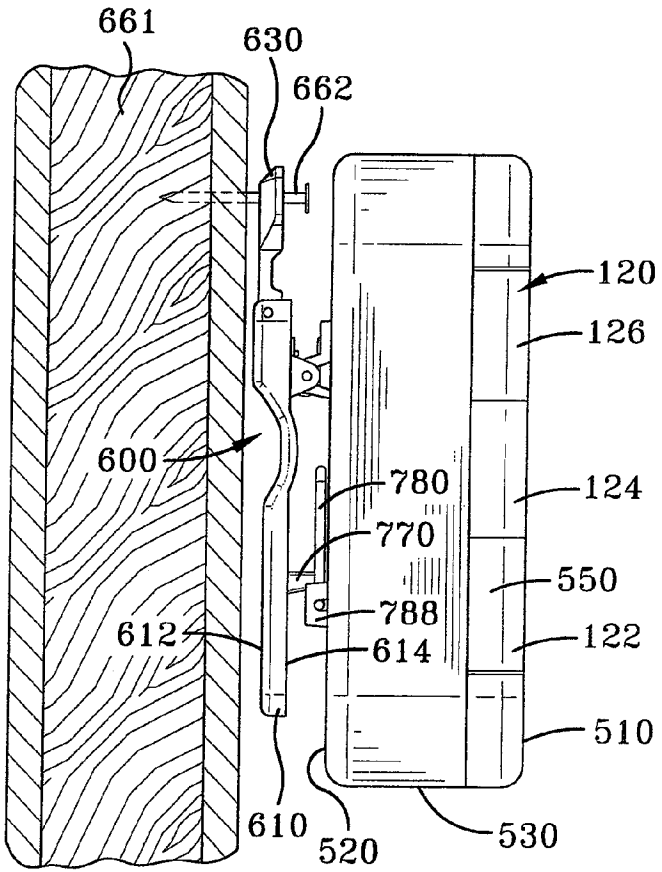
FIG. 12 is a side elevational view of the visual alert device showing the manner in which it can be attached to a wall via a hang tab of the clip.
Figure 11:
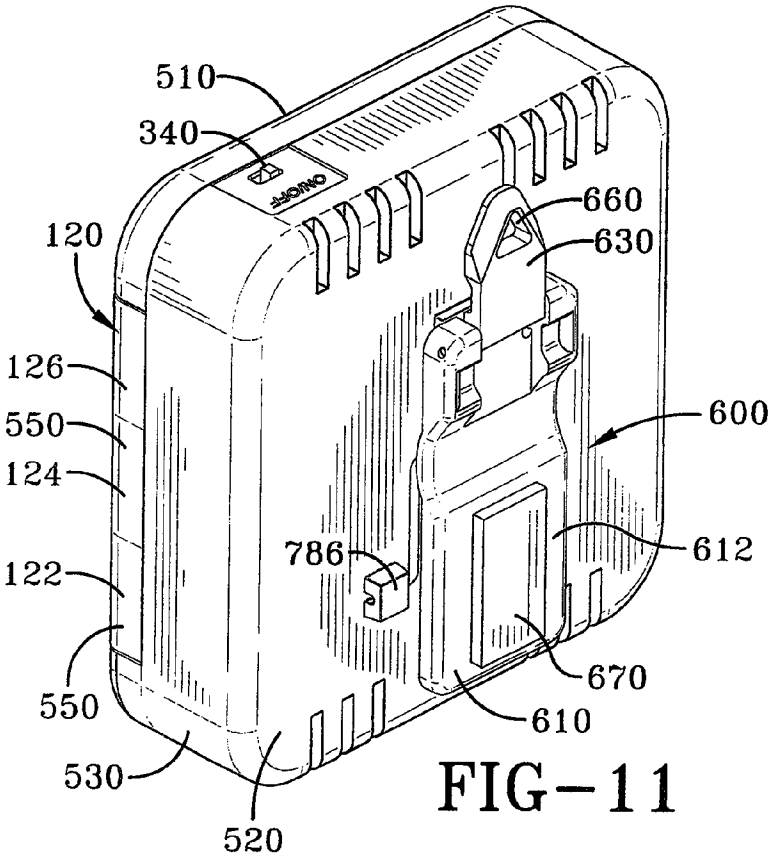
FIG. 11 is a perspective view of the rear surface of the visual alert device.
Figure 13:
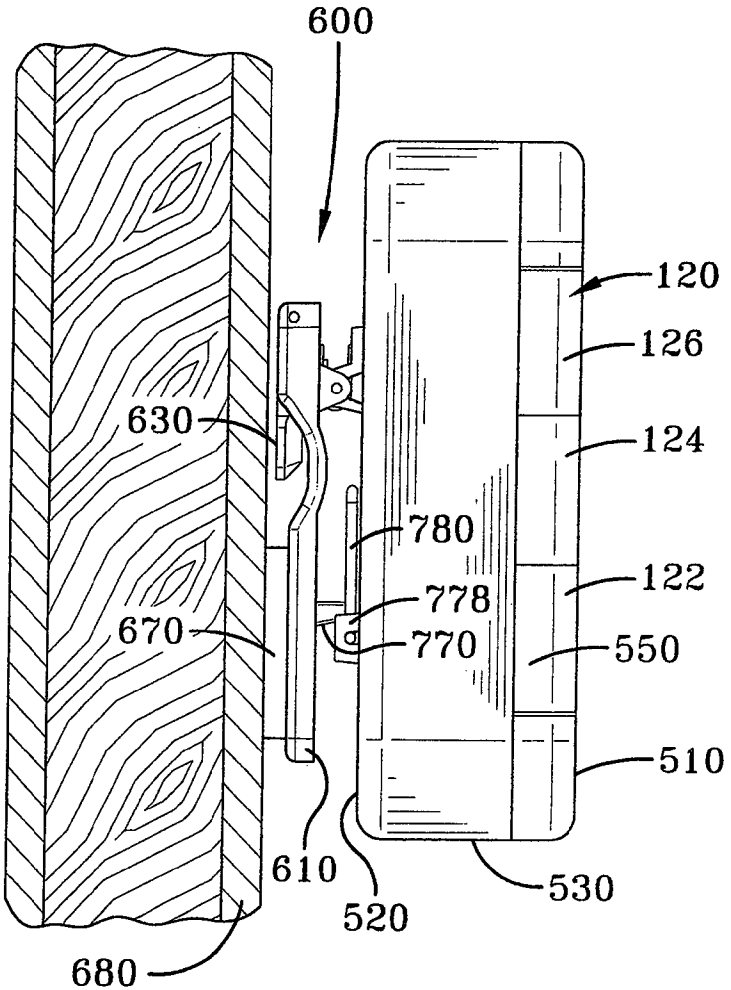
FIG. 13 is a side elevational view of the visual alert device that is attached to a metal door frame by a magnet of the clip.

As shown in FIGS. 4-10, the rear surface 520 of the housing 500 carries an attachment assembly 600, which allows the visual alert device 100 to be mounted or positioned in various manners to be discussed. Specifically, the attachment assembly 600 includes a clip 610 having an outer surface 612 and an opposed inner surface 614. Extending from the clip 610 are two spaced, substantially parallel legs 620 and 622, with a hang tab 630 being disposed between legs 620 and 622. The hang tab 630 includes an aperture 632 that is axially aligned with apertures 640 and 642 in legs 620 and 622. A retention pin 650 is received through each of the apertures 632, 640, and 642 to pivotably retain the hang tab 630 to the clip 610. The hang tab 630 includes a mounting aperture 660 that allows the visual alert device 100 to be hung from any suitable point of attachment 661, such as a wall, by a fastener 662, such as a tack or nail, as shown in FIG. 12. Also extending between the legs 620, 622 of the clip 610 is a backstop 663, which is in engagement with a substantially rectangular stop surface 664 maintained by the hang tab 630. Thus, as the hang tab 630 is rotated from a resting position, as shown in FIG. 8, to an active or upright position, as shown in FIG. 12, the stop surface 664 of the hang tab 630 rotatably engages the backstop 663, so that it does not freely rotate and thereby keeps the hang tab 630 in the desired resting or active position. Attached to the outer surface 612 of the clip 610 is a magnet 670, which allows the visual alert device 100 to be attached to any suitable surface, such as a metal door frame 680, as shown in FIG. 13. The magnet 670 may be attached to the clip 610 using any suitable adhesive, as well as any other suitable means of fixation.

Figure 6:
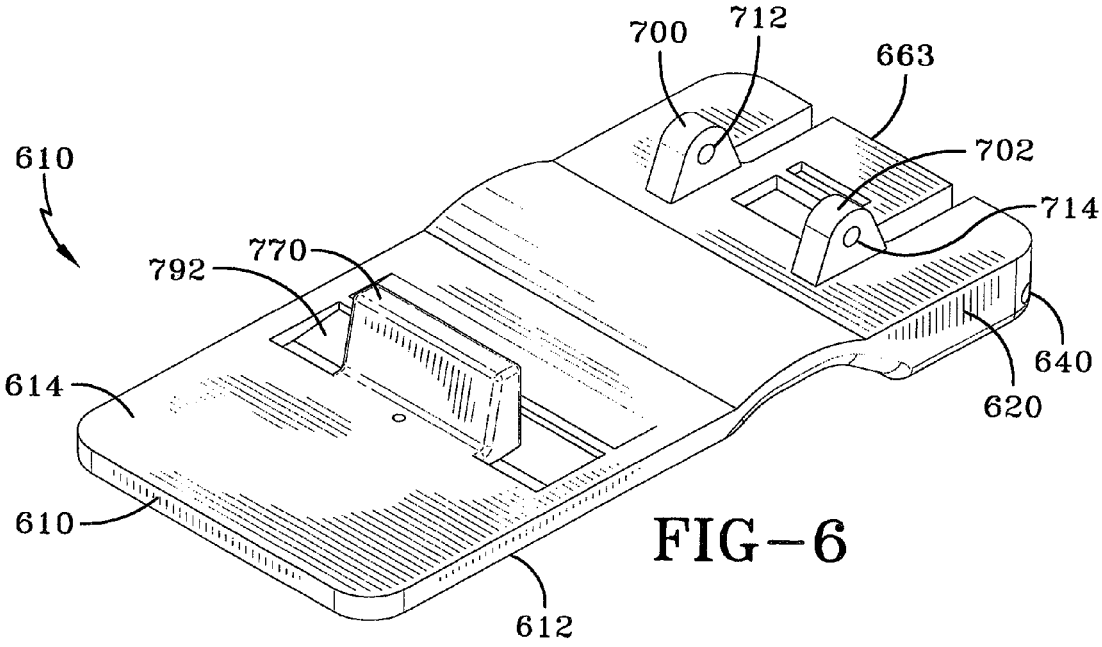
FIG. 6 is a perspective view of the inner surface of the clip of FIG. 5.

The inner surface 614 of the clip 610 includes a pair of spaced clip arms 700, 702 that maintain respective axially-aligned clip apertures 712 and 714, shown clearly in FIG. 6. The clip apertures 712, 714 of the clip arms 700, 702 are disposed to the outside and axially aligned with a pair of housing apertures 730 and 732 that are maintained by respective housing arms 740, 742 that extend from the rear surface 520 of the housing 500 of the visual alert device 100. Disposed between the housing arms 740, 742 is a spring 750 having an aperture 752 that is axially aligned with the housing apertures 730, 732 and the clip apertures 712, 714 through which a retention pin 760 is received to pivotably retain the clip 610 to the housing 500. Thus, the clip 610 is biased to a closed state or position by the spring 750, such that a stop 770 extending at a substantially right angle from the inner surface 614 of the clip 610 is urged against the rear surface 520 of the housing 500, as shown in FIG. 8. As such, the clip 610 allows the visual alert device 100 to be attached to various items as needed.

In addition, the clip 610 can be kept at its open state or position by a standoff 780, which is pivotably attached at each end 774 and 776 by a pair of respective apertures 782, 784 maintained by respective anchors 786 and 788 extending from the rear surface 520 of the housing 500. The standoff 780 maintains an engagement section 790, which is dimensioned to be received within a retention channel 792, shown in FIGS. 6 and 9, that is disposed within the inner surface 614 of the clip 610. As such, the visual alert device 100 can be placed upright upon a table, stand, or any other substantially flat surface, shown in FIG. 10.

Figure 10:
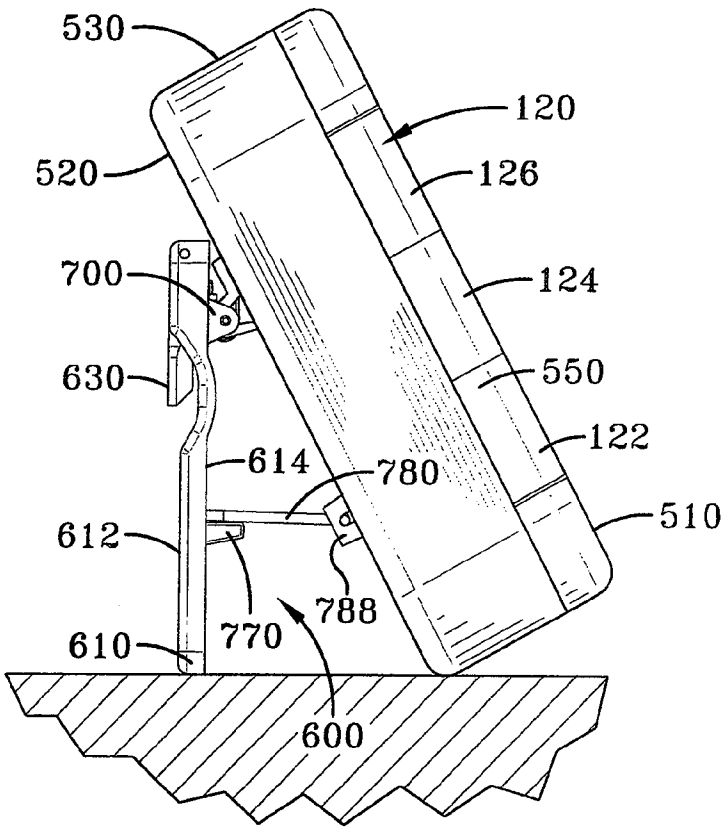
FIG. 10 is a side elevational view of the visual alert device positioned upon a surface.
Figure 9:
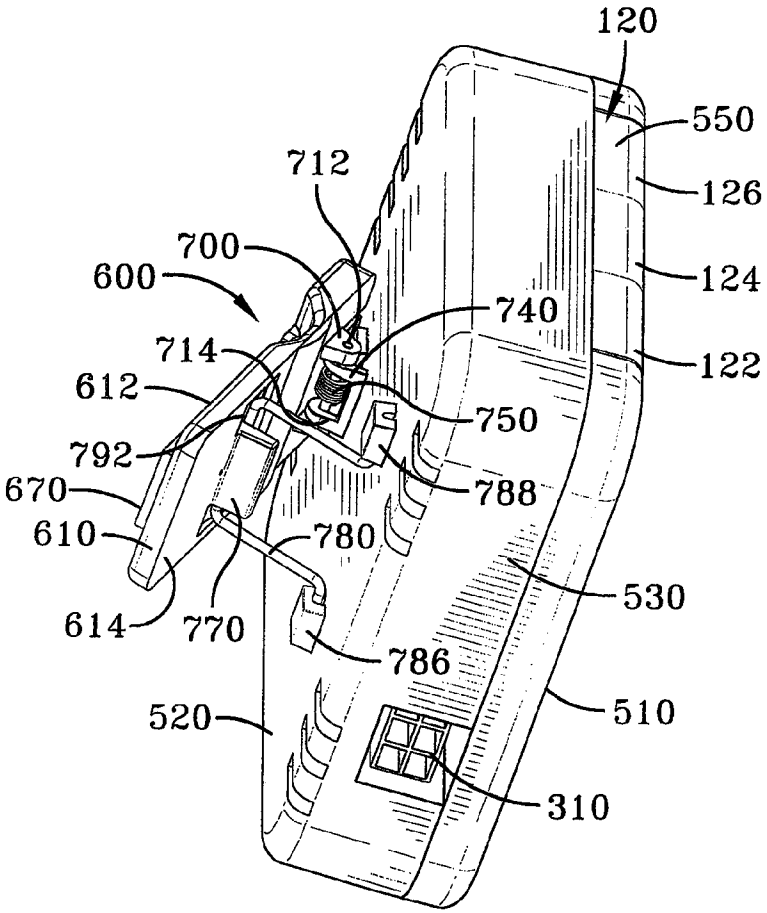
FIG. 9 is a perspective view of the attachment assembly of the visual alert device.

Thus, the attachment assembly 600 utilized by the visual alert device 100 provides a wide range of mounting options that facilitate its effective visual identification by the caregiver. As previously discussed, the spring-biased clip 610 can also be used to attach the visual alert device 100 to a medical chart, chart holder, or other item, or the clip 610 may be held open via the standoff 780 to allow the visual alert device 100 to be set upright on a table or other surface, as shown in FIG. 10. In addition, the mounting aperture 660 of the hang tab 630, shown in the active position in FIG. 11, also allows the visual alert device 100 to be hung or otherwise attached to any structure 661, such as a wall, by any suitable fastener 662, such as a nail, screw, clip, or the like, as shown in FIG. 12. Furthermore, the magnet 670 maintained by the clip 610 can be used to attach the visual alert device 100 to the metal door frame 680, as shown in FIG. 13, or any other metallic structure. Thus, the wide range of mounting options provided by the visual alert device 100 allow it to be located away from areas that have significant visual clutter and away from other electronic devices that provide distracting visual indications and prompts.

Figure 14A:
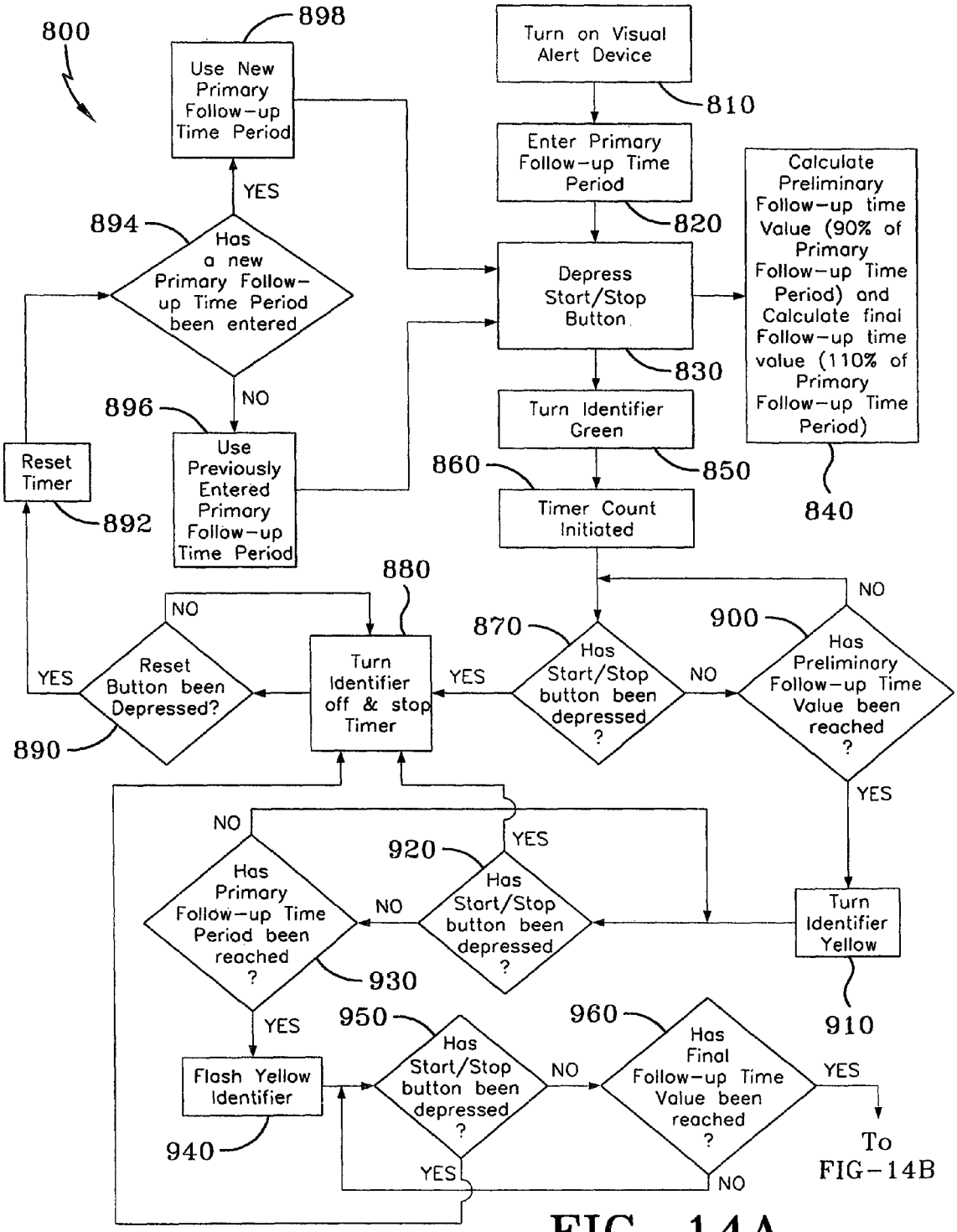
FIGS. 14A-B are a flow diagram of the operational steps taken by the visual alert device during operation in accordance with the concepts of the present invention.
Figure 14B:
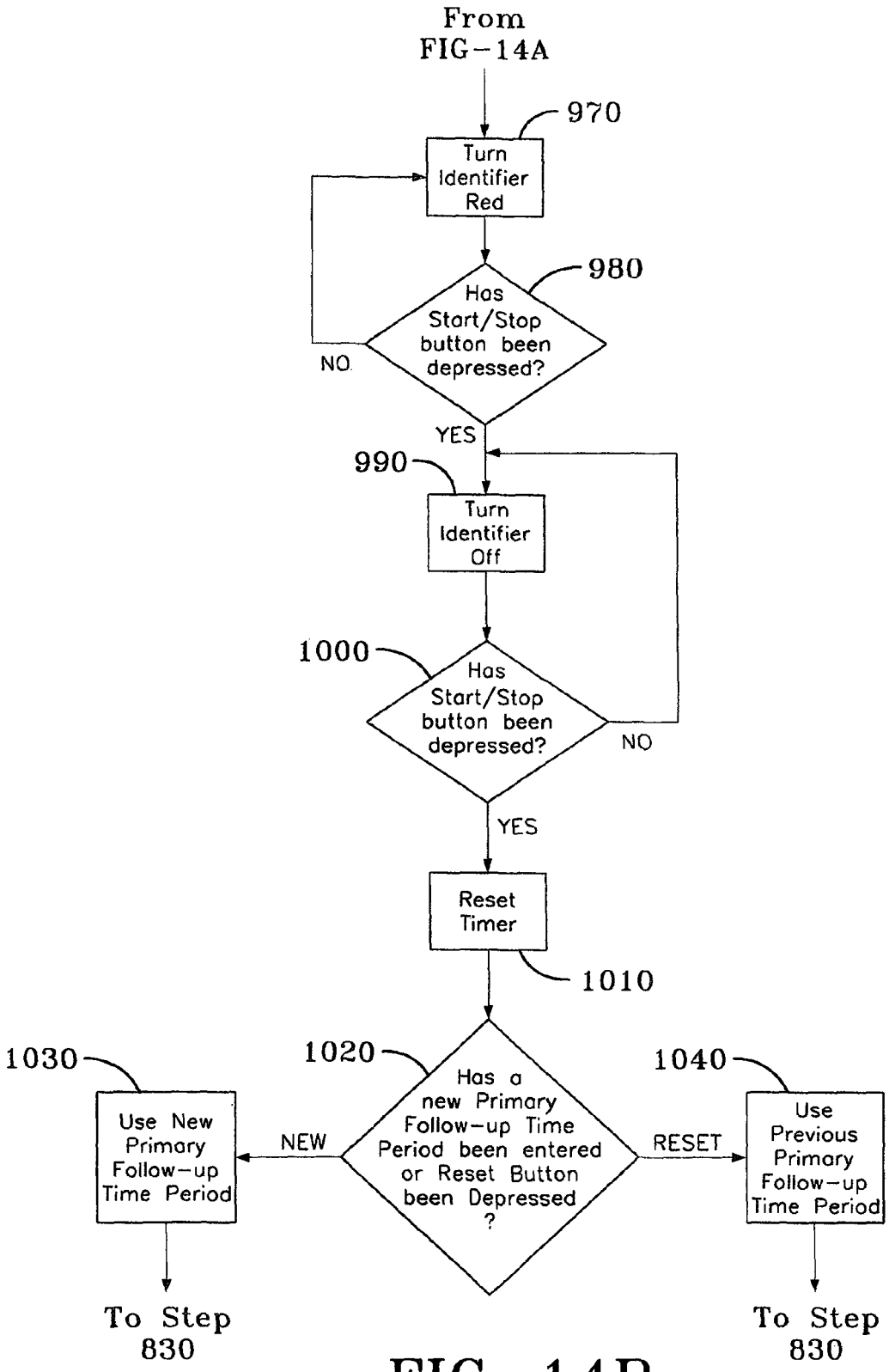

Having discussed the structural details of the visual alert device 100, the operational steps, referred to generally by the numeral 800, as shown in FIGS. 14A-B, which are taken when the visual alert device 100 is placed into operation, will now be discussed in detail. Initially, at step 810, the visual alert device 100 is turned on by actuation of the on/off switch 340. Once the device 100 is turned on, the user inputs a primary follow-up time period via the numeric keypad 110, which is shown on the display 250, as indicated at step 820. For example, the user may enter the follow-up time period in minutes, although the device 100 may be configured so that values of time may be entered in any other suitable increments of time, such as days, hours or seconds for example. Next, at step 830, after the desired follow-up time period has been entered, the start/stop button 230 is depressed.

Somewhat simultaneously with step 830, steps 840 and 850 are performed, whereby at step 840, the controller 200 computes a preliminary follow-up time value, for example, that is 90% of the primary follow-up time period and computes a final follow-up time value that is, for example, 110% of the primary follow-up time period, and at step 850, the green color segment 122 of the illuminable identifiers 120 are illuminated. After the illuminable identifiers 120 are turned green, the process 800 continues to step 860, where the timer 210 is initiated. It should be appreciated that the count maintained by the timer 210 may be decremented from the primary follow-up period entered at step 820 or incremented from zero to the primary follow-up time period. Next, at step 870, the process determines whether the user has depressed the start/stop button 230, such that if it has been depressed, the illuminable identifiers 120 are turned off, and the count of the timer 210 is stopped, as indicated at step 880. Once the count is stopped, the process 800 continues to step 890, where the process determines whether the reset button 240 has been depressed. If the reset button 240 has been depressed, the timer 210 is reset at step 892 before continuing to step 894, where the process determines whether a new primary follow-up time period has been entered. If a new primary follow-up time period has not been entered at step 894, the timer 210 uses the previously-entered primary follow-up time period, as indicated at step 896, before returning to step 830. Alternatively, if a new primary follow-up time period has been entered at step 894, the process continues to step 898, where the new primary follow-up time period is used upon returning to step 830.

However, if the start/stop button 230 has not been depressed at step 870, the process continues to step 900, where the process 800 determines whether the timer 210 has reached the preliminary follow-up time value. If the preliminary follow-up time value has not been reached, the process 800 returns to step 870; however, if the preliminary follow-up time value has been reached, the process 800 continues to step 910, where the yellow color segment 124 of the illuminable identifiers 120 are illuminated. Next, at step 920, the process 800 determines if the start/stop button 230 has been depressed or not. If the start/stop button 230 has been depressed at step 920, the process returns to step 880, where the illuminable identifiers 120 are turned off and the timer 210 is stopped just prior to determining whether the reset button 240 has been depressed at step 890, as previously discussed.

However, if at step 920, the start/stop button 230 has not been depressed, the process continues to step 930, where the process determines whether the timer 210 has reached the primary follow-up time period. If the timer 210 has not reached the primary follow-up time period, the process remains at step 920, however, if the primary follow-up time period has been reached, the process continues to step 940, where the yellow color segment 124 of the illuminable identifiers 120 are pulsed or otherwise flashed on and off.

Next, at step 950, the process determines whether the start/stop button 230 has been depressed, such that if it has been depressed, the process returns to step 880, where the illuminable identifier 120 is turned off and the count of the timer 210 is stopped just before the process determines whether the reset button 240 has been depressed at step 890, as previously discussed. However, if the start/stop button 230 has not been depressed at step 950, the process continues to step 960, where the process determines whether the timer 210 has reached the final follow-up time value. If the timer 210 has not reached the final follow-up time value at step 960, the process returns to step 950, although if the timer 210 has reached the final follow-up time value, the process continues to step 970 where the red color segment 126 of the illuminable identifiers 120 is illuminated.

Next, at step 980 the process determines whether the start/stop button 230 has been depressed, such that if it has not been depressed, the process remains at step 970. However, if the start/stop button 230 is depressed at step 980, the process continues to step 990, where the illuminable identifier 120 is turned off. After the illuminable identifier 120 is turned off, the process continues to step 1000, where the process determines whether the start/stop button 230 has been depressed. If the start/stop button 230 has not been depressed, the process remains at step 990, although if the reset button 240 has been depressed, the process continues to step 1010, whereby the timer 210 is reset. Once the timer 210 has been reset, the process continues to step 1020, where the process determines whether a new primary follow-up time period has been entered at the keypad 110. If a new primary follow-up time period has been entered, the new time period is used by the process as indicated at step 1030 upon returning to step 830. Alternatively, if the reset button 240 has been actuated at step 1020, the process continues to step 1040 where the previously-entered primary follow-up time period is used by the process upon returning to step 830.

Thus, based on the process 800 discussed above, if a user enters a primary follow-up time period of, for example, 60 minutes via the keypad 110 and depresses the start/stop button 230, the preliminary follow-up time value is computed as 54 minutes (90% of the 60-minute primary follow-up time period), and the final follow-up time value is computed as 66 minutes (110% of the 60-minute primary follow-up time period). Somewhat simultaneously with the depression of the start/stop button 230, the green color segment 122 is illuminated, and the timer 210 is started. Next, the green color segment 122 is illuminated until the timer 210 reaches the preliminary follow-up time value of 54 minutes, at which time the green color segment 122 is turned off and the yellow color segment 124 is illuminated. Once the primary follow-up time period of 60 minutes is reached by the timer 210, the yellow color segment 124 begins to flash, pulse, or otherwise blink. Finally, after the final follow-up time period of 66 minutes has been reached, the yellow color segment 124 is turned off, and the red color segment 126 is illuminated and remains illuminated until the start/stop button 230 is depressed.

Thus, by associating colors, such as green, yellow, and red, with specific points in time before (preliminary follow-up time value) and after (final follow-up time value) the expiration of the primary follow-up time period, the user is able to identify the urgency or level of priority that needs to be given to a patient or any other timed activity that is being monitored using the visual alert device 100.

In view of the foregoing discussion, it should be apparent that a visual alert device constructed and operated as described herein accomplishes the objects of the invention and otherwise substantially improves the art.

What is claimed is:

1. A visual alert device comprising:

at least one illuminable identifier having at least three different color segments;

a controller coupled to said illuminable identifier to control the illumination of said color segments, said controller including a timer;

a numeric keypad coupled to said controller to enter a predetermined primary follow-up time period, said controller computing at least a preliminary and final follow-up time value;

a housing to carry said at least one illuminable identifier, such that said illuminable identifier maintains a primary illuminating surface on the front of said housing that continuously extends at a substantially right angle to a lateral illuminating surface on a side of said housing; and a start/stop button coupled to said controller;

wherein said timer counts down the predetermined primary follow-up time period;

wherein when said start/stop button is actuated, said first color segment is illuminated and said timer is started, such that when said timer reaches said preliminary follow-up time value, said second color segment is illuminated, when said timer reaches said primary follow-up time period, said second color segment is pulsed, and when said timer reaches said final follow-up time value, said third color segment is illuminated.

2. The visual alert device of claim 1, wherein said preliminary follow-up time value is approximately 90% of said primary follow-up time period, and said final follow-up time value is approximately 110% of said primary follow-up time period.

3. The visual alert device of claim 1, further comprising a display coupled to said controller to present said primary follow-up time period.

4. The visual alert device of claim 1, further comprising a transmitter coupled to said controller to wirelessly communicate which one of said color segments is currently illuminated to a remote reception module maintaining an indicator, said indicator generating a prompt based on said currently illuminated color segment.

5. The visual alert device of claim 1, further comprising:

a memory unit coupled to said controller to store the number of times each of said color segments has been illuminated; and a data port coupled to said controller, said data port configured to communicate the number of times each of said color segments has been illuminated to a remote computing device coupled to said data port.

6. The visual alert device of claim 1, further comprising a clip pivotably attached to said housing, such that said clip may be pivoted to either of an open position distal said housing and to a closed position proximate said housing.

7. The visual alert device of claim 6, further comprising a spring in operative engagement with said clip to bias said clip to said closed position.

8. The visual alert device of claim 7, further comprising a pivotable standoff carried by said housing to engage a retention channel disposed in said clip, so as to maintain said clip at said open position.

9. The visual alert device of claim 6, further comprising a hang tab pivotably carried by said clip, said tab having a mounting aperture.

10. The visual alert device of claim 6, further comprising a magnet attached to said clip.

11. A method to provide a visual alert comprising the steps of:

providing a charger base comprising a plurality of dock ports, providing a plurality of visual alert devices, said visual alert devices being connectable to and removable from said dock ports, where said visual alert devices comprise a keypad, a timer, and an illuminable identifier having at least three different color segments;

entering a predetermined primary follow-up time period into two or more visual alert devices via the keypads;

computing a preliminary and a final follow-up time value based on the primary follow-up time period;

initiating said timers to count down said predetermined primary follow-up time period;

illuminating the first color segments;

illuminating the second color segments when the timers reach the preliminary follow-up time value;

pulsing the second color segments when the timers reach the primary follow-up time period; and illuminating the third color segments when the timers reach the final follow-up time value.

12. The method of claim 11, wherein at the computing step, the preliminary follow-up time value is computed as approximately 90% of the primary follow-up time period, and the final follow-up time value is computed as approximately 110% of the primary follow-up time period.

13. The method of claim 11, further comprising the step of collecting data associated with each instance that each one of the color segments is illuminated.

14. The method of claim 13, further comprising the step of communicating the collected data to a remote computing device.

15. The method of claim 11, further comprising the step of providing a remote reception module having an indicator.

16. The method of claim 15, further comprising the step of transmitting a communication signal identifying which color segment is currently illuminated to the remote reception module, whereupon the indicator generates a prompt based on the currently illuminated color segment.

17. A visual alert device comprising:

a housing having a front surface and opposed side surfaces extending therefrom at substantially right angles to said front surface;

a first illuminable identifier having an illuminating surface extending continuously from said front surface to one of said side surfaces and having a plurality of different color segments;

a second illuminable identifier having an illuminating surface extending continuously from said front surface to the other of said side surfaces and having a plurality of different color segments;

a controller carried in said housing and coupled to said illuminable identifiers to control the illumination of the color segments, said controller including a timer;

a numeric keypad and said front surface coupled to said controller to enter a predetermined primary follow-up time period; and a start/stop button coupled to said controller;

wherein said timer counts down the predetermined primary follow-up time period;

wherein when said start/stop button is actuated a first color segment is illuminated and said tinier is started, and when said timer reaches said primary follow-up time period, a second color segment is illuminated.

18. The visual alert device of claim 17, further comprising a transmitter coupled to said controller to wirelessly communicate which one of said color segments is currently illuminated to a remote reception module maintaining an indicator, said indicator generating a prompt based on said currently illuminated color segment.

19. The visual alert device of claim 17, further comprising:

a memory unit coupled to said controller to store the number of times each of said color segments has been illuminated; and a data port coupled to said controller, said data port configured to communicate the number of times each of said color segments has been illuminated to a remote computing device coupled to said data port.

* * * * *